United States Patent [19]

Kühner et al.

[11] Patent Number: 4,861,326

[45] Date of Patent: Aug. 29, 1989

[54] MODULAR FOLDING APPARATUS

[75] Inventors: Rudolf Kühner, Rimpar; Günter K. Schmitt, Würzburg; Rudolf Stäb, Frankenthal, all of Fed. Rep. of Germany

[73] Assignee: Albert-Frankenthal AG, Frankenthal, Fed. Rep. of Germany

[21] Appl. No.: 73,183

[22] Filed: Jul. 14, 1987

[30] Foreign Application Priority Data

Aug. 2, 1986 [DE] Fed. Rep. of Germany ..... 3626287

[51] Int. Cl.[4] ..... B65H 45/28; B65H 45/16

[52] U.S. Cl. ..... 493/359; 493/357; 493/424; 493/458; 493/477; 493/478

[58] Field of Search ..... 493/359, 360, 424, 425, 493/426, 427, 428, 429, 430, 477, 478, 479, 480

[56] References Cited

U.S. PATENT DOCUMENTS

| | | | |
|---|---|---|---|
| 2,253,446 | 8/1941 | Spiess | 493/360 |
| 3,784,187 | 1/1974 | Takayanagi et al. | 493/359 |
| 4,159,823 | 7/1979 | Bryer et al. | 493/425 |
| 4,167,265 | 9/1979 | Whittenberger | 493/421 |
| 4,490,132 | 12/1984 | Ogura et al. | 493/424 |
| 4,611,799 | 9/1986 | Nuttin | 493/410 |

FOREIGN PATENT DOCUMENTS

| | | | |
|---|---|---|---|
| 2101974 | 1/1983 | United Kingdom | 493/426 |

*Primary Examiner*—Frederick R. Schmidt
*Assistant Examiner*—William E. Terrell
*Attorney, Agent, or Firm*—Jones, Tullar & Cooper

[57] ABSTRACT

In a folding apparatus with a transverse cutting and transverse folding unit fed by a first longitudinal folding unit and with a second longitudinal folding unit followed by a delivery unit, simple development and expansion of the folding apparatus step by step is made possible by arranging the transverse cutting and transverse folding unit on a basic frame and arranging the second longitudinal folding unit on a lower additional frame. Furthermore the basic and additional frame are arranged at the same level and are provided with connection structure adjacent to each other and over the connection on the basic frame there is a further connection structure for a superposed frame with transverse and longitudinal forming unit. The additional frame is provided with support surfaces for the superposed frame which has corresponding surfaces. The additional frame and the superposed frame are provided with an add-on frame with a transverse folding delivery unit on their connection structure situated on the side remote from the basic frame.

23 Claims, 5 Drawing Sheets

MODULAR FOLDING APPARATUS

BACKGROUND OF THE INVENTION

The invention relates to a folding apparatus comprising at least one transverse cutting and transverse folding device, which is arranged to be fed by a first longitudinal folding unit (preferably in the form of a former folder) and having a cutting cylinder, a cylinder having a folding blade and pins, and a jaw folding cylinder, and with at least one second longitudinal folding unit which has a tape conveyor running through it and is adapted to feed a delivery unit.

Prior art folding apparatuses been generally designed for specific applications so that it is not able to be later modified and employed for other purposes at reasonable expense. This however means that such folding apparaturses uneconomic inasfar as when new jobs are to be tackled practically the whole of the apparatus has to be replaced.

SUMMARY OF THE INVENTION.

Accordingly one object of the present invention is to devise a folding apparatus of the initially mentioned type which is based on a simple basic module arrangement such that the folding apparatus may be expanded and developed step by step.

In order to achieve this or other objects appearing from the present specification and claims, a folding apparatus is characterized by having a multi-module structure in which the transverse cutting and transverse folding unit is mounted on a basic frame comprising a folding apparatus intake means, the second longitudinal folding unit is mounted on an additional frame separate therefrom, the basic frame and the additional frame are arranged at the same bottom level and are provided with adjacently placed connection means, of which the connection means of the basic frame is located in the vicinity of the folding jaw cylinder on the basic frame, such jaw cylinder being at a lower level than the folding blade cylinder cooperating therewith, such folding blade cylinder being located in the vicinity of a further connection means (on the basic frame and associated with an upper working plane) for a superposed frame having a jaw folding cylinder, and a further second longitudinal unit, fed by the folding jaw cylinder, such additional frame being so designed that adjacent to its second longitudinal folding unit it has connection means formed by support surfaces for the superposed frame (which has suitable connection means adjacent to its second longitudinal folding unit), and on their side remote from the basic frame the additional frame and the superposed frame are provided with superposed connection means for one respective add-on frame with at least one transverse folder delivery unit able to be actuated as an alternative to the second longitudinal folding units.

The advantage of the invention as so defined is to be seen in the provision of a modular system in which additional modules may be added to the basic equipment to develop it step by step. Thus it becomes possible to start with a very simple and accordingly cheap module arrangement, consisting for instance of the basic frame and the additional frame without barring later development and expansion. In the simplest basic module arrangement the basic frame and the additional frame have their mutual connection means directly adjoining. In a further stage the basic frame and the additional frame may be at a distance from each other, with a further module between them which has suitable connection means. Owing to the fact that on the basic frame and on the additional frame there are connection means associated with a module having a second working plane, by the addition of the superposed frame (which is provided with suitable connection means) it is readily possible to establish a second working plane as part of a further stage of development. The superposed frame is best made in a number of parts and may thus always be so modified in length that the two second longitudinal folding units are always superposed with full alignment, this simplifying the equipment. Since the superposed frame and the additional frame have connection means on their sides remote from the basic frame for further modules, the latter may be built up for instance in the form of add-on means comprising a transverse folder delivery means if a further add-on stage is to contain a transverse folder delivery means. The advantages of the step-by-step expansion and adaptation of a folder made possible by the invention are thus to be seen more especially in highly economic operation, since simple and economic adaptation to the requirements of individual cases and customization are possible without requiring a completely new folding apparatus. In fact, only the relevant modules are needed.

Advantageous further developments and features of the invention are defined in the claims.

One working example of the invention will now be described with reference to the drawings.

DETAILED DESCRIPTION OF THE PREFREED EMBODIMENTS OF THE INVENTION.

Figure 1A:
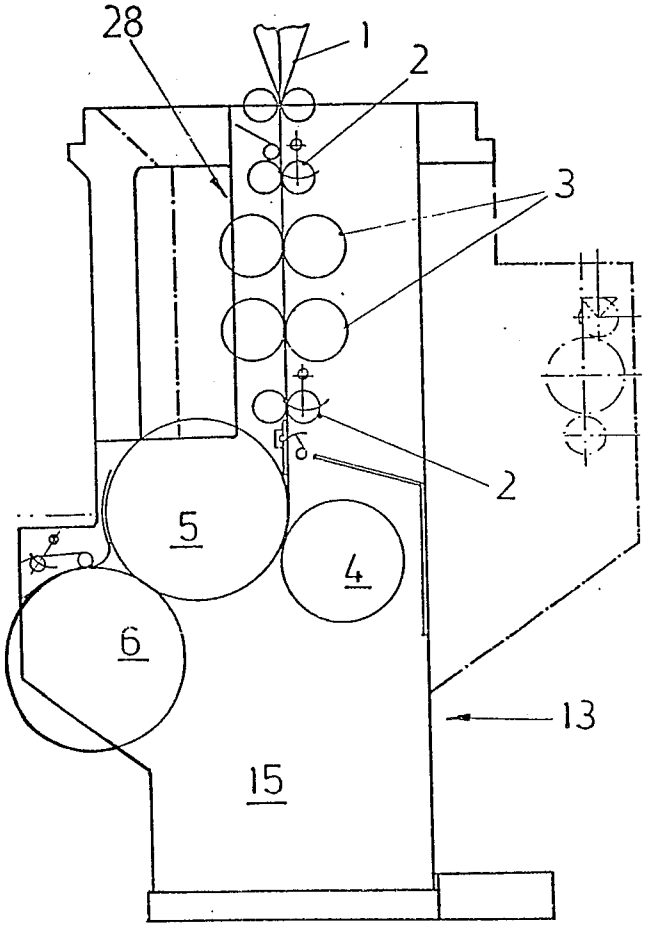
FIG. 1A is a side view of the apparatus of FIG. 1 highlighting its modular nature.
Figure 1:
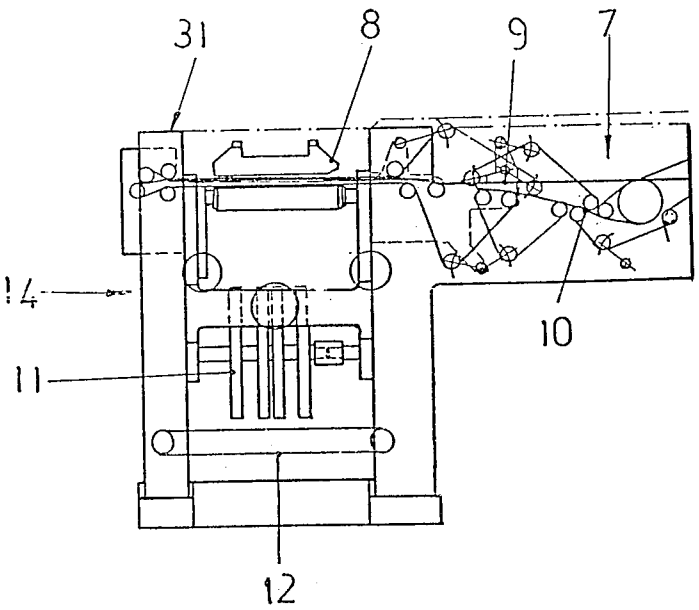
FIG. 1 is a side view of the folding apparatus in accordance with the invention with two modules belonging to a basic structure

The folding apparatus shown in FIG. 1 makes possible the production of folded products with two longitudinal folds and one transverse fold. Since the basics of the structure and manner of operation of folding apparatuses for such products are well known, no detailed account is provided here.

The first longitudinal fold is produced by means of a former 1, which may be provided on the frame of a printing machine used with the folding apparatus. In place of the former folder it is naturally possible for the web to be opened up by cutting; the two possibilities are in what follows generically referred to as the first longitudinal fold. The web coming from the former 1 is drawn in by draw rols 2 into the folding apparatus and subdivided in the latter in a conventional manner into sequential sections, which are provided with a transverse fold and then with a second longitudinal fold. the folding operations may be facilitated by making perforations in the web and for this purpose there are pin rolls 3 arranged at the inlet of the folding apparatus. The transverse cutting and transverse folding units are formed by three sequentially arranged cylinders 4, 5 and 6. The center cylinder 5 is provided with cutting grooves, which cooperate with the cutting knives on the engaging cylinder 4 to perform the transvers cut. The cutting grooves are associated in a conventional manner with pins engaging the leading end of the web when cutting takes place. The cylinder 5 is fruthermore provided with fold blades which cooperate with fold jaws provided on the cylinder 6. The cylinder 4 is in what follows referred to as the blade cylinder, the cylinder 5 as the pin and blade folder cylinder and the cylinder 6 as the fold jaw cylinder. The fold blade cylinder 5 is able to be switched over from collect run production to non-collect run production. By the same token, the speed of the cylinder forming the transverse cutting and transverse folding unit and of the following parts may be so modified that the transverse cut may take place on half the periphery or on the entire periphery.

The fold jaw cylinder 6 is linked with a second longitudinal folding unit 8 by means of a conveyor 7 and the second unit has a folding tucker blade cooperating with folding rolls. The second longitudinal folding unit 8 has the conveyor 7 passing through it, whose input end cooperates with the fold jaw cylinder 6 and for reducing the products supplied to the second longitudinal folding unit 8 it is provided with a delaying unit 9 which is made up of sections of the belt conveyor 7 running at different speeds and in interleaving relationship with each other as known in the art. In order to be able to displace the second longitudinal folding unit with the conveyor tapes in accordance with the paper size, that is to say normally to the plane of the drawing, the conveyor 7 is provided at one point with a further division without any interleaving. At a lower level than the folding rolls of the second longitudinal folding unit 8 there is a delivery unit with a fan wheel 11 and a delivery belt 12 over which it passes.

The folding apparatus shown in FIG. 1 is made up of two mutually separate modules 13 and 14 which are here directly adjoining. The first module 13 comprises a basic frame 15 which is arranged under the former 1 and comprises the folding apparatus intake with the drawing and perforating rolls 2 and 3 and the transverse cutting and transverse folding units with the cutting cylinder 4, the pin and folding blade cylinder 5 and the folding jaw cylinder 6, such frame 15 extending for the full height as far as the folding former 1. The second module 14 consists of an additional frame 16 extending for generally half the height of the first module 13 and which comprises the belt conveyor 7, the second longitudinal folding unit 8 and the delivery unit associated therewith in the form of the fan wheel 11 and the delivery belt 12. The basic frame 15 and the additional frame 16 arranged at the same level as the basic frame 15 are provided with facing connection means 17 and 18, which are here in the form of abutting surfaces. In the module arrangement of FIG. 1 they are in directly abutting relationship. They may be connected together by removable screws.

Since the additional frame 16 only extends for about half the height of the basic frame 15 the connection means 17 of the basic frame 15 associated with the additional frame 16 is on the lower half of the frame. In this part there also is the folding jaw cylinder 6 on the basic frame and the cooperating belt conveyor 7 on the additional frame cooperating herewith, this enabling efficient cooperation to take place.

Figure 3:
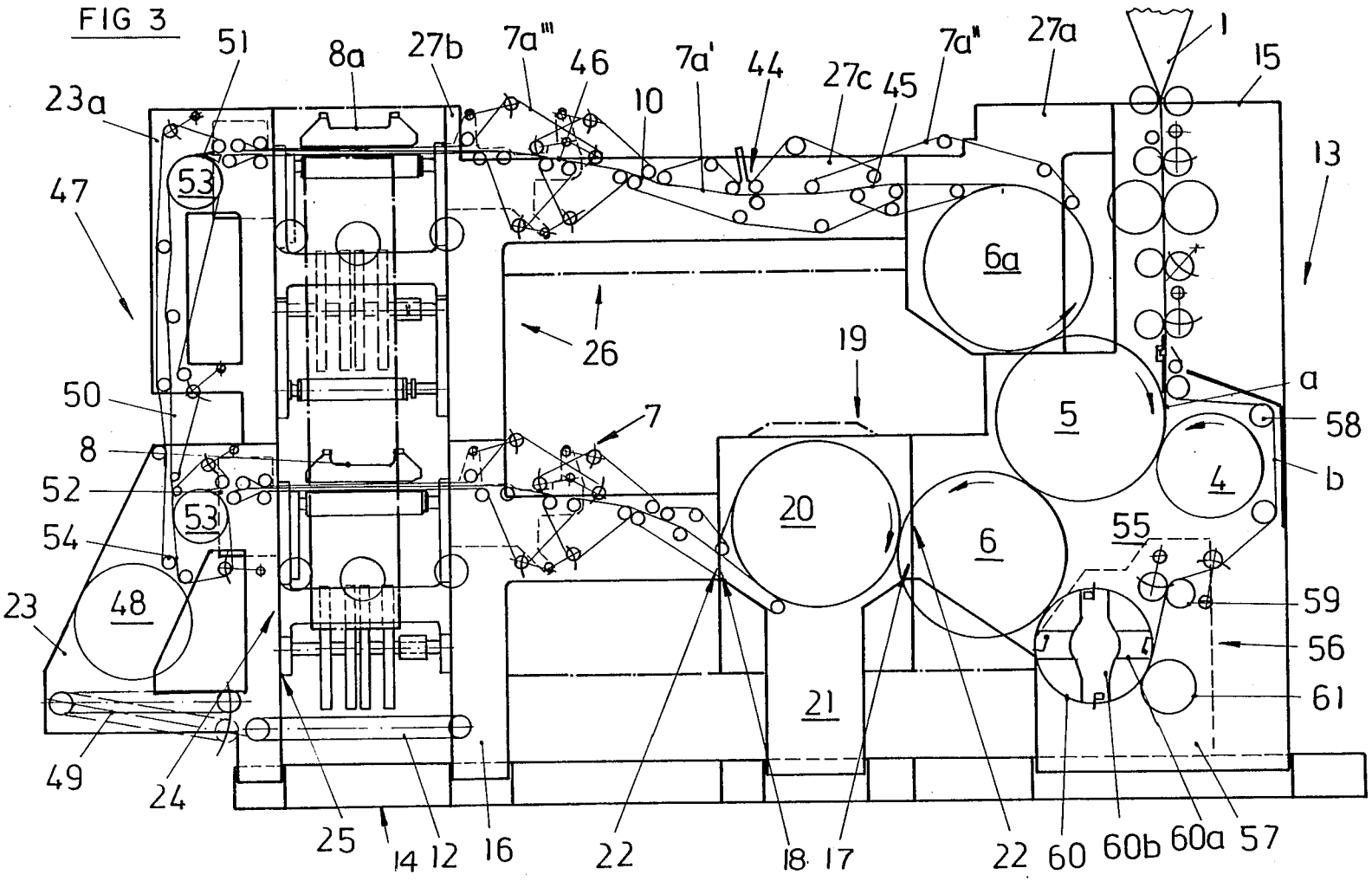
FIG. 3 is a side view of the folding apparatus in accordance with the invention in end stage of development.

In a further module arrangement it is possible to consider, for instance, the production of doubly folded products. For this purpose, see FIG. 3 showing the ultimate module arrangement, it is possible to have a further module 19 between the modules 13 and 14. This further module 19 consists of an intermediate frame 21 carrying a folding jaw cylinder 20 and this intermediate frame has side connection means 22 adjoining the mutually facing connection means 17 and 18 of the basic frame 15 and of the additional frame 16. The folding jaw cylinder 6 is in this case simultaneously armed with folding blades. For this purpose the original cylinder, only having folding jaws, may be replaced by a different cylinder. In accordance with another possible form of the invention the module 19 would have the belt conveyor 7 passing through it and would be provided with a buckle folding unit cooperating therewith.

The cylinders 20 and 6, which are in mesh with each other, run in different directions. These directions are so selected that the lower cylinder 6 in the basic frame 15 has its part of the circumference on the delivery side turning downwards and the upper cylinder 20 of the additional frame 21 has its circumference on the delivery side turning upwards. Accordingly the belt conveyor 7, as may be seen from FIG. 1, engages the upper half of the lower cylinder 6 and (see FIG. 3) the lower half of the upper cylinder 20. The second longitudinal folding device 8 having the belt conveyor 7 running generally horizontally through it, is generally at the same level as the top of the lower cylinder 6 so that the belt conveyor 7, which is adjacent to the upper side of the additional frame 16 with half the height, may be brought into engagement with cylinder 6 or with the cylinder 20 in a similar manner without any substantial alteration. In this respect owing to the height, which is in accord with the two cylinders 6 and 20, the belt conveyor 7 only has to be altered with respect to the inlet, something that may be done by insertion or removal of the bend rolls required for the respective arrangement, and for this purpose it is possible for the additional frame 16 to have suitable bearing holes therein right from the start.

If the delivery of the products is desired without any second longitudinal fold, it is possible to adopt a further stage as shown in FIG. 3 with a further added module inasfar as there is an add-on frame 23, comprising a transverse fold delivery unit, on the side of the additional frame 16 remote from the basic frame. The additional frame 16 is in this case provided with a connection means 24 on its side remote from the basic frame. This connection means 24 fits a connection means 25 of the add-on frame 23. When the transverse folding delivery unit of the add-on frame 23 is operated the second longitudinal folding unit 8 will be obviously turned off.

A further module arrangement may be produced by the introduction of a second working plane. A simple module arrangement on these lines is to be seen in FIG.

2 in which there is a further module 26 offset in an upward direction in relation to the module 14. The further module 26 comprises a superposed frame 27 with folding jaw cylinder 6a cooperating with the pin and folding blade cylinder 5 on the basic frame and forming a second transverse folding unit. The cylinder 6a is connected by a conveyor 7a with a following, second longitudinal folding unit 8a, under which there is a delivery unit with a fan wheel 11a and a cooperating delivery belt 12a. The basic frame 15 has an upper connection means 28 which is upwardly offset in relation to the connection means 17 and in the present case having a stepped form. An associated connection means 29 on the superposed frame 27 may fit the connection means for forming a joint. Likewise the basic frame 16 having the superposed frame 27 thereover is provided with a connection means 30 formed by a receiving surface and on which the superposed frame 27 may be mounted with a connection means 31 formed by a corresponding deposit surface. The superposed frame 26 is in this respect so designed that the second longitudinal folding unit 8 and 8a have their respective delivery unit superimposed with full alignment.

The superposed frame 27 may for its part be made up of a number of parts. In the design in accordance with FIG. 2 the module 26 is made up of two parts, of which one corresponds practically to the module 14 located thereunder and the other part comprises the folding blade cylinder 6a. The mutual point 32 of abutment of the two parts of the module 26 is practically in line with the abutment position, located thereunder, between the connection means 17 and 18 of the basic frame 15 and the additional frame 16. The two folding jaw cylinders 6 and 6a are aligned or placed with some offset over each other and offset by 120° on the periphery of the folding blade cylinder 5.

Figure 2:
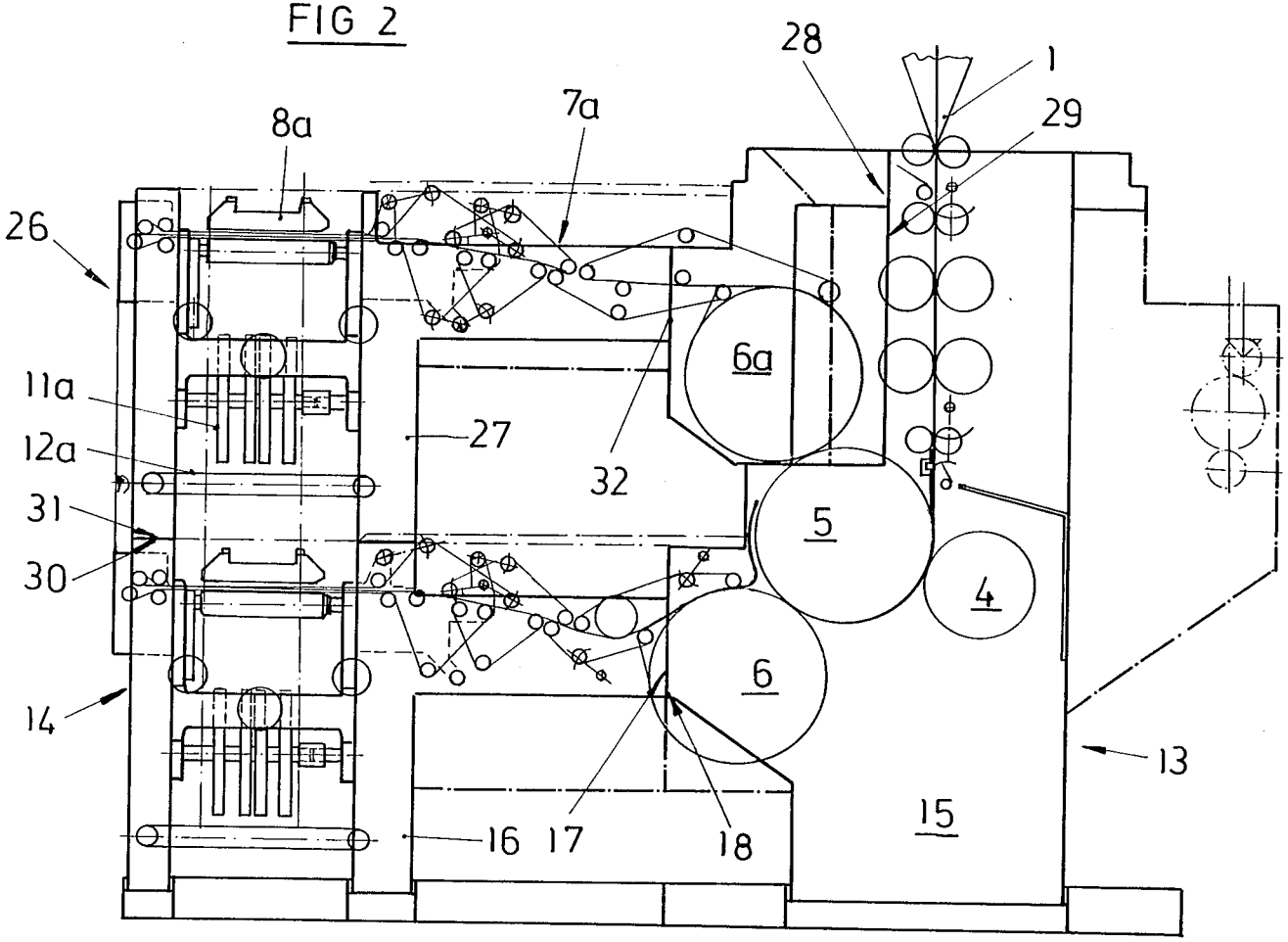
FIG. 2 is a side view of the folding apparatus in accordance with the invention in a second stage of development with two superposed working planes.

Using a folding apparatus with the module arrangement as shown in FIG. 2 it is possible for succeeding web sections to be processed and delivered along different paths. Inasfar as a transverse fold delivery should be desired in the present module arrangement, it is possible to have a corresponding means adjoining the additional frame and the superposed frame, in the form of the above-noted add-on frame 23.

Figure 4:
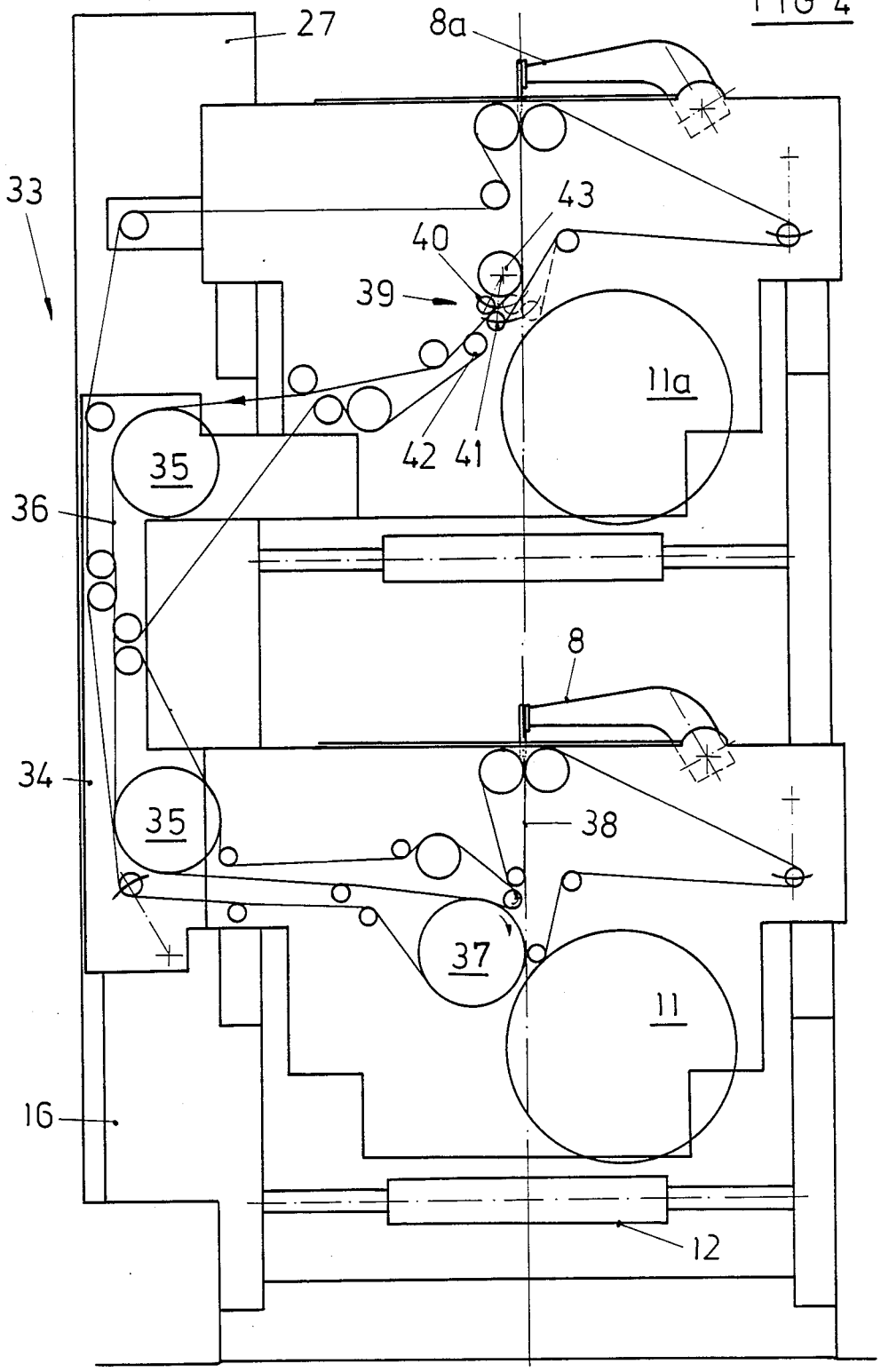
FIG. 4 is an example of a delivery unit associated with the longitudinal folding units which are superposed in the stages shown in FIGS. 2 and 3.

In the arrangement in accordance with FIG. 2 each second longitudinal folding unit 8 and 8a is followed by a respective associated delivery unit. In a second module arrangement it is possible to provide for intake of the products emerging adjacent to the two second longitudinal folding units 8 and 8a into one and the same fan wheel, something that facilitates further processing. For this purpose the module 33 of the type shown in FIG. 4 may be utilized. This module comprises a frame 34 spanning the additional frame 16 and the superposed frame 27 at the side, and on which the bend means 35 of one belt conveyor 36 are placed, which has a generally C-like configuration extending from the upper second longitudinal folding unit 8a to the lower second longitudinal folding unit 8. The additional frame 16 and the superposed frame 27 are provided with side connection means associated with the side frame 34.

The products coming from the upper and from the lower second longitudinal folding unit are charged into the fan wheel 11 at the same point and for this purpose to the side and above the fan wheel 11 there is a comparatively large bend roll 37 about which one set of belts of a lower section of the belt conveyor 36 is trained and which has a tangential relationship to the other belt set of the belt conveyor 36 and, downstream therefrom, the belt set, nearer to the center of the fan wheel 11, of a belt conveyor 38 for drawing off the products from the folding rolls of the lower second longitudinal folding unit 8. The other belt set of the belt conveyor 38 comes to an end over the bend roll 37 and, respectively, the belt set at a tangent thereto of the belt conveyor 36. The belts of an upper section of the belt conveyor 36 run from the folding rolls of the upper second longitudinal folding unit around the same to guarantee an efficient draw off of the products.

Inasfar as a selective delivery via the lower fan wheel 11 or via the two fan wheels 11 and 11a is desired it is possible for the belt conveyor 36 to be provided with a switch 39 over the fan wheel 11a and this switch would then be able to be switched over from a position indicated in full lines leading to the lower fan wheel 11 into a further position indicated in broken lines leading to the upper fan wheel 11a. The switch 39 in this case comprises two bend rolls 40 and 41 which are mounted on a pivoting frame. The belt set remote from the fan wheel 11a of the belt conveyor 36 runs through the switch 39 without any interruption. This belt set has the bend roll 40 remote from the fan wheel 11a fitting under it. The other belt set of the belt conveyor 36 is interrupted at the switch 39, the lower section being trained around the roll 41 opposite to the roll 40. The lower section is trained around the stationary roll 42 opposite the pivoting bend roll 41 in the position denoted in continuous lines. In the pivot position of the bend rolls 40 and 41 indicated in broken lines there is a continuous transport plane in the vicinity of the switch 39 so that the products pass into the part of the belt conveyor 36 running to the lower fan wheel 11. By pivoting the rolls 40 and 41 into the position indicated in broken lines the transport plane of the part of the belt conveyor 36 coming from the upper folding rolls is pivoted out of the part of the belt conveyor 36 which is under the stationary bend roll 42 so that the products are deposited in the upper fan wheel 11a located thereunder. Over the pivoting roll 40 and 41 there is a stationary belt roll 43 which facilitates the deflection of the uninterrupted belt set.

The most developed module arrangement, shown in FIG. 3, is distinguished from the intermediate module arrangement of FIG. 2 inter alia inasfar as there is the intermediate frame 21 in the lower working plane between the basic frame 15 and the additional frame 16, such intermediate frame 21 forming the module 19 and having the folding jaw cylinder 20. The cylinder 6 on the basic frame and cooperating with the folding jaw cylinder is in this case provided with folding jaws and folding blades. In this respect the folding jaw cylinder located at this position in the basic arrangement in accordance with FIG. 1 is replaced by a corresponding combination cylinder. The replaced folding jaw cylinder may be used as the fold jaw cylinder 61 of the superposed module 26 in this module arrangement. The drive of the folding jaw cylinders 6a and 20 located outside the basic frame 15 is taken from the respective adjacent basic frame cylinder. The drive of the basic frame cylinders is conventionally taken from the main drive of the machine.

Owing to the presence of the intermediate frame 21 the distance of the additional frame 16 from the basic frame 15 is increased so as to be greater than in the arrangements in accordance with FIGS. 1 and 2. Accordingly the superposed frame 27 also becomes longer and in this respect there is an intermediate piece 27c between the folding jaw cylinder 6a and the parts 27a and 27b forming the second longitudinal folding unit 8a, such intermediate piece 27c having a length exactly equal to the length of the intermediate frame 21 so that the second longitudinal folding units 8 and 8a are placed in vertically aligned relationship one over the other as was previously the case. The belt conveyor 7a connecting the upper folding jaw cylinder 6a with the following second longitudinal unit 8a is arranged to run through the intermediate piece 27c. In the present working example illustrated the intermediate piece 27c is furnished with a buckle folding unit 44 cooperating with the belt conveyor 7a, the buckle passage of this unit 44 and the rear squeeze roll being able to be pivoted in such a manner that the products fed by the belt conveyor 7a are able to be selectively fed into the buckle passage or moved past the same. The buckle folding unit 44 makes it possible to produce a second transverse fold in the upper working plane. It would also be possible to produce a second or further transverse fold in the lower working plane by the use of a buckle folding unit of the sort denoted at 44. This folding unit might be mounted on the intermediate frame 21, that is to say formed part and parcel of the module 19. In this case the lower belt conveyor 7 would cooperate with folding jaw cylinder 6 on the basic frame just as the upper belt conveyor 7a cooperates with the folding jaw cylinder 6a on the superposed frame so that there would be more or less the same belt conveyor arrangements and folding jaw cylinder designs above and below.

The paths in the upper and the lower working planes differ from each other so that the products are delivered with a corresponding offset. As a rule however an offset equal only to a complete product length is allowable. In order to allow for the differences in the paths there is a variable speed, driven section 7a' in the upper belt conveyor 7a. This section is driven by means of a variable ratio v-belt system independently of the previous and following sections 7a'' and 7a'''. The rear section 7a'' cooperating with the folding jaw cylinder 6a runs at the peripheral speed of the cylinder. The front section passing through the second associated longitudinal section 8a runs at a fixed ratio at a speed which is less than or equal to the speed of the section 7a''. The transfer of the products between the different sections is at the interleaved parts of the belts at 45 and 56 in a conventional manner. The interruption 10 required to ensure lateral adjustability of the second longitudinal folding unit 8a may be provided in the center section 7a driven at a variable speed.

Figure 6:
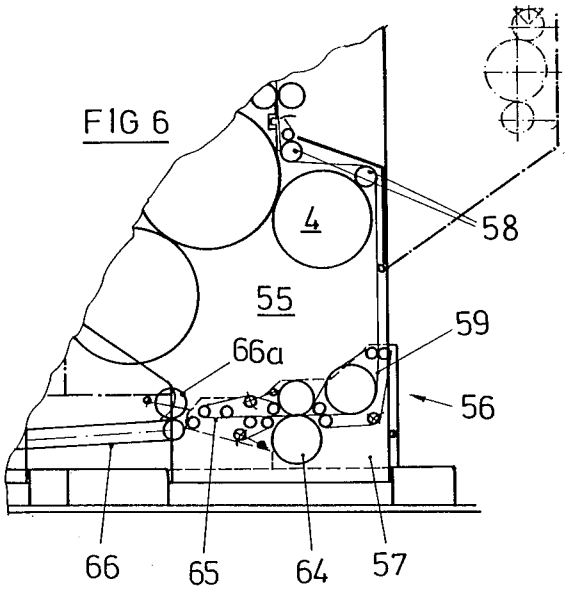
FIG. 6 shows a working example of a push-in module which makes possible an upright form of delivery, in a view similar to that of FIG. 3.

In the module arrangement shown in FIG. 3 there is a transverse folder delivery unit, which is able to be actuated as an alternative to the second longitudinal folding units 8 and 8a and which may be added in the form of a second module 47. The module 47 consists of an add-on frame 23 as described above and able to be connected to the additional frame 16 on the side remote from the basic frame 15, and an add-on frame 23a able to be joined to the superposed frame 27 in the same manner. On the lower add-on frame 23 there is a fan wheel 48 which fits over a delivery belt 49 and which is loaded by a descending belt conveyor 50 spanning the two add-on frames 23 and 23a. The belt conveyor 50 has an upper intake 51 aligned with the end of the upper belt conveyor 7a extending through the upper second longitudinal folding unit 8a and a lower intake 52 which is aligned with the end of the belt conveyor 7 extending through the lower second transverse folding unit. In order to ensure an efficient draw-in action at the intakes 51 and 52 there is in each case a bend roll 53 having a comparatively large diameter, around which one belt set of the belt conveyor 50 is tranined and which cooperates with a further belt set of the belt conveyor 50 in forming a narrowing intake passage. The belt set trained about the upper bend roll 53 comes to an end over the lower bend roll 53. The belt set engaging the upper bend roll 53 is at a tangent to the lower bend roll 53 and cooperates with the belt set trained therearound in forming an outlet of the belt conveyor 50 on the fan wheel side, such outlet being defined by bend wheels 54 arranged over the fan wheel 48. The belt set engaging the lower bend roll 53 for forming the intake 52 comes to an end at the point of contact of the continuous belt set. This leads to an efficient draw-in of the products at the two intakes 51 and 52. The products drawn in via the upper intake 51 and the lower intake 52 may be fed one after the other or on top of each other to the fan wheel 48, the insertion of the products taking place at the very same position, something that facilitates control. As will furthermore be seen from FIG. 3 the basic frame 15 has a chamber-like accommodating space 55 under the cylinders arranged generally like a roof and which owing to the smaller diameter of the cutting cylinder 5, which is at a somewhat higher level than the folding jaw cylinder 6, is open at the rear. In a further module arrangement it is possible to have a further module 56 in the accommodating space 55. In this respect, as will be seen from a glance at FIGS. 3 and 6, it may be a question of different instrumentalities. In any case the module 56 will have a frame 57 able to be inserted between the side walls of the basic frame 15, there being suitable connection means on the side walls of the frame or of the foundation. A stream of material moving around the basic frame cutting cylinder 4 will be supplied to the module 56 in both cases. The basic frame 15 is accordingly provided with bend rolls 58 running around the cutting cylinder or it has an adaptation allowing the provision of such bend rolls. The stream of material supplied to the module 56 is drawn in by means of a draw-in unit 59 on the module and which in the case of FIG. 3 is formed by draw rolls able to be brought into engagement with each other and in the case of FIG. 6 is formed by a draw-in belt. In the arrangement of FIG. 3 a pin and folding jaw cylinder 60 is accommodated on the inserted frame 57 and it engages the folding jaw cylinder on the basic frame. It furthermore has its own cutting cylinder 61. Such an arrangement makes it possible to split up the stream of material running through the former 1 into two streams a and b at the inlet of the folding apparatus and to cause the one stream to pass via the basic frame transverse cutting unit and the upper folding jaw cylinder 6a onto the upper belt conveyor 7a and to cause the other stream to pass via the transverse cutting unit on the intake side and the lower folding jaw cylinder 6 or the folding jaw cylinder 20 coming thereafter into the lower belt conveyor 7.

Figure 5:
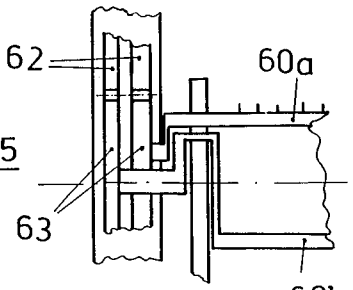
FIG. 5 shows one possible example of the drive of the push-in module provided in the stage in accordance with FIG. 3 on the basic frame.

The pin and folding jaw cylinder 60 consists in a conventional manner of pin part 60a and a folding blade part 60b. The drive is so designed that the pin part 60a is driven from the pin part and the folding blade part 60b from the basic frame pin and folding blade cylinder 5. As will best be seen from FIG. 5 this purpose is served by two basic frame spur gear wheels 62 in the vicinity of the accommodating space 55, such wheels being drivingly connected with the pin part and the folding blade part of the pin and folding blade cylinder 5 on the basic frame and with which the spur gear wheels 63 (which are connected with the pin part 60*a* and the folding blade part 60*b* of the cylinder 50 on the accommodating frame side) may be brought into engagement. The mutual connection means on the basic frame 15 and the inserted frame 57 are so designed that in the connected state there is a proper tooth-to-tooth engagement between the spur gear wheels 62 and the drive wheels 63. In place of the gear wheel connection it would be possible to have a positive clutch between the shaft ends opposite each other in the inserted state.

The drive of the arrangement of FIG. 6 may be designed in a similar manner. In this arrangement the draw-in belt 59 is followed by a transverse cutting means 64 which cooperates with a following draw-off belt 65 allowing, in practice, a variation in product format. The web sections produced by means of the transverse cutting unit 64 are not transferred to one of the basic frame cylinders but placed on a separate delivery conveyor 66 following the draw-off belt 65, such conveyor 66 being able to follow the delivery belts 12 and 49, respectively. On transfer of the products from the draw-off belt 65 to the delivery conveyor 66 the products are caused to overlap and for this purpose the delivery conveyor 66 is driven at a suitably lower speed than the draw-off belt running with a slight lead or advance in relation to the belt speed. For forming an overlapped product stream there is a braking roll 66*a* which is associated with the delivery conveyor and swings upwards and downwards in step with the incoming products.

Figure 7:
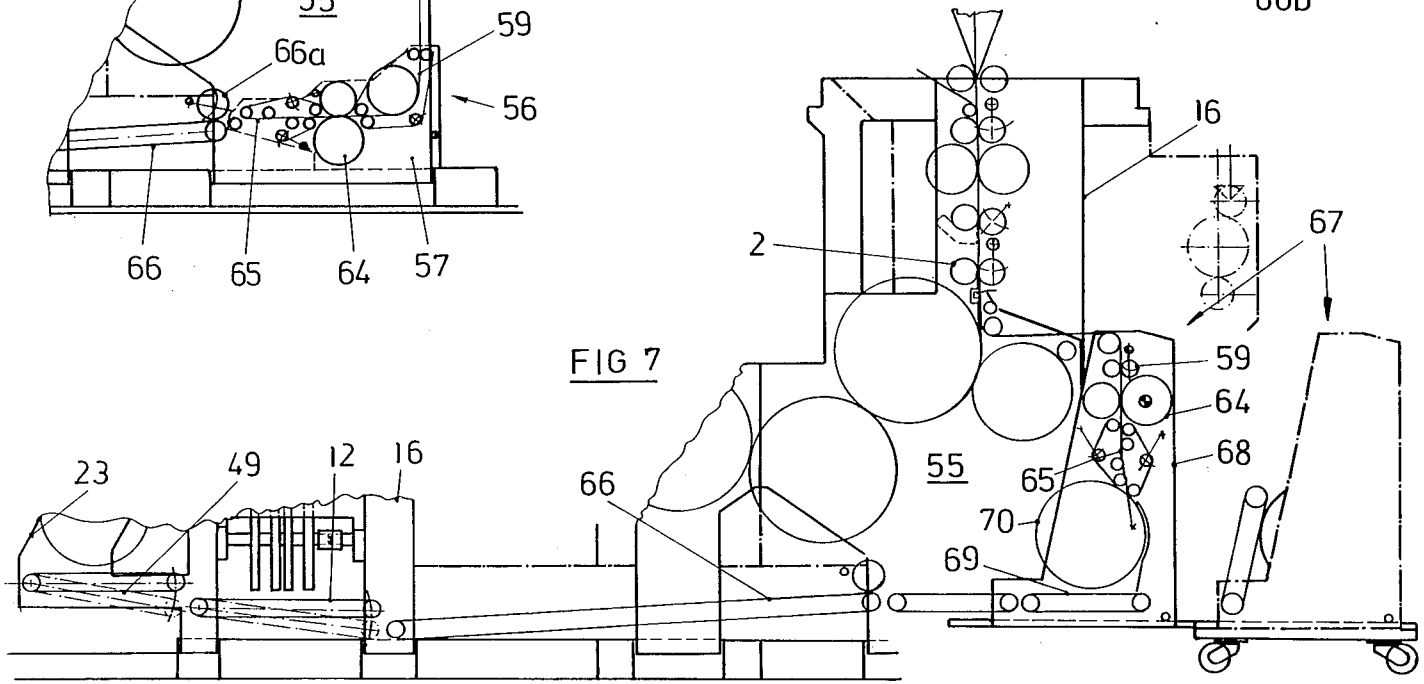
FIG. 7 shows an example of a further stage with a traveling module and so designed as to make possible an upright delivery.

In a further module arrangement to be seen in FIG. 7 it is possible to have a further module 67 with a traveling add-on frame 68 able to be fitted at the rear onto the basic frame 16 so as to fit partly into the accommodation space 55. This add-on frame 68 also has its own draw-in unit 59 with its own following transverse cutting unit 64 and a draw-in belt 65 coming after it. After the latter there is a fan wheel 70, serving to cause product overlap, extending over a delivery belt 69. The latter adjoins the delivery conveyor 66 mentioned earlier in the context of FIG. 6 and extending under the lower working plane. The conveyor 66 transfers the products to the delivery belt 12 on the additional frame. The belt 12 for its part transfers to the delivery belt 49 on the add-on frame. The sequentially placed belts are located at different heights and able to be so pivoted that they may be engaged and disengaged with each other. The drive of the module 67 may be simply derived from the basic frame draw rolls 2 inasfar as the shaft ends, which are aligned with each other in the operative state, are connected with each other by a coupling piece. The module 67 or 56 is preferably supplied with the entire web running through the former 1 or only a stream split off from it. Inasfar as the entire web of material is caused to run through the module 67 or 56, as is preferred, it is possible for the folding apparatus drive to be turned off downstream from the draw-in rolls 2.

We claim:

1. A folding apparatus, comprising a plurality of separate modules, one of said modules including a basic frame having connecting means and further connecting means, and to which folding apparatus intake means and at least one transverse cutting and transverse folding unit are mounted, said at least one traverse cutting and transverse folding unit adapted to be fed by a longitudinal folding unit and having a cutting cylinder, a cylinder having a folding blade and pins and a folding jaw cylinder, another of said modules including an additional frame having connecting means and to which at least one further longitudinal folding unit is mounted, said at least one further longitudinal folding unit having a belt conveyor adapted to feed a delivery unit, and a further one of said modules including a superposed frame having another folding jaw cylinder mounted thereto and another longitudinal folding unit associated therewith, said another longitudinal folding unit being fed by said another folding jaw cylinder, said superposed frame having support surfaces forming connection means, wherein:

the basic frame and the additional frame having aligned bottom levels, the connecting means of said basic frame is located in the vicinity of the folding jaw cylinder of said basic frame, said folding jaw cylinder being at a lower level than the folding blade cylinder and said folding blade cylinder being located in the vicinity of said further connecting means, and on their side remote from said basic frame, said additional frame and said superposed frame being provided with superposed connecting means for one respective add-on frame with at least one transverse folder delivery unit which can be actuated as an alternative to said at least one further longitudinal folding unit.

2. The folding apparatus as claimed in claim 1, wherein said superposed frame comprises a plurality of parts, each having connection means turned towards each other and in line with the connection means of the frames associated with said superposed frame.

3. The folding apparatus as claimed in claim 1, further comprising a still further one of said modules including an intermediate frame having connecting means, said intermediate frame being situated between the facing connection means of said basic frame and said additional frame said intermediate frame having means for the production of at least one further transverse fold.

4. The folding apparatus as claimed in claim 3, further comprising an intermediate piece, wherein said superposed frame is extended by means of said intermediate piece having the same length as the intermediate frame located thereunder, such intermediate piece having a further belt conveyor passing through it.

5. The folding apparatus as claimed in claim 4, wherein said further belt conveyor includes a section driven at varied speeds.

6. The folding apparatus as claimed in claim 5, wherein the section of said further belt conveyor whose speed is able to be varied is interleaved at the intake end with a section cooperating with the preceding folding jaw cylinder and on the outlet end with a section extending through the associated at least one further longitudinal folding unit, said outlet end section being able to be driven at a speed which is less than the speed of the intake end section.

7. The folding apparatus as claimed in claim 6, wherein the section whose speed is able to be varied comprises two section parts adjoining each other without interleaving, said two section parts being driven at respectively the same speed.

8. The folding apparatus as claimed in claim 6, wherein the speed of the outlet end section is half of the speed of the intake end section.

9. The folding apparatus as claimed in claim 4, further comprising a transverse folding delivery unit loaded by said belt conveyor and said further belt conveyor and activated in alternate relationship with said at least one further longitudinal folding unit, said transverse folding delivery unit having a fan wheel placed on a lower add-on frame and extending over a delivery belt, said fan wheel arranged to be loaded by a descending belt conveyor, which has a lower intake provided adjacent to a bend roll on an upper add-on frame and which is in line with the end of said further belt conveyor and a lower intake provided adjacent to a bend roll on said lower add-on frame which is in line with the end of said further belt conveyor.

10. The folding apparatus as claimed in claim 3 wherein said folding blade cylinder on the basic frame comprises a combination cylinder provided with folding knives and folding blades and serving as a folding jaw cylinder mounted on said superposed frame.

11. The folding apparatus as claimed in claim 3, wherein said means for the production of at least one further transverse fold comprises a folding jaw cylinder engageable with the belt conveyor of said at least one further longitudinal folding unit and with said folding jaw cylinder on said basic frame, said folding jaw cylinder of said means for the production of at least one further transverse fold includes additional folding blades.

12. The folding apparatus as claimed in claim 1, wherein another one of said modules includes a buckle folding unit provided adjacent said belt conveyor, said buckle folding unit being able to be put in and out of operation.

13. The folding apparatus as claimed in claim 12, wherein said buckle folding unit is mounted on said intermediate piece.

14. The folding apparatus as claimed in claim 12, wherein said buckle folding unit is mounted on said intermediate frame.

15. The folding apparatus as claimed in claim 1, further comprising a still further one of said modules mounted laterally between the additional frame and the superposed frame, said still further one of said modules comprising a side frame to receive bend rolls forming a transfer means of a generally C-like belt conveyor, said belt conveyor extending from the folding rolls of said another longitudinal folding unit to a fan wheel placed after the folding rolls of said at least one longitudinal folding unit, such fan wheel fitting over a delivery belt.

16. The folding apparatus as claimed in claim 15, further comprising a belt set of a descending belt conveyor following the folding rolls of said another longitudinal folding unit, said belt set being near to the center of the fan wheel and in tangential relationship to a bend roll placed over the fan wheel, which at a point upstream is in tangential relationship to a belt set of a belt conveyor forming the transfer means.

17. The folding apparatus as claimed in claim 16 wherein the bend roll has a belt set of the belt conveyor forming the transfer means trained around it.

18. The folding apparatus as claimed in claim 15, further comprising switch means, and wherein fan wheels are placed after both said longitudinal folding units and by means of said switch means the belt conveyor forming the transfer means may be switched over from a position leading to the upper fan wheel into a position leading to the lower fan wheel and back again.

19. The folding apparatus as claimed in claim 18, wherein the switch means has two pivoting bend rolls of which the bend roll nearer the center of the adjacent upper fan wheel guides a belt set ending over the upper fan wheel of the transfer means coming from the folding rolls of said at least one longitudinal folding unit, and another belt set thereof is extended past the upper fan wheel and has the other bend roll fitting around behind it.

20. The folding apparatus as claimed in claim 19, further comprising a stationary bend roll and a bend roll above the pivoting belt rolls and fitted around behind both the belt sets, wherein one of said belt sets is interrupted and the other of said belt sets is uninterrupted, and wherein the stationary bend roll is situated under the pivoting belt rolls engaging the uninterrupted belt set and receiving the lower section of the interrupted belt set.

21. The folding apparatus as claimed in claim 1, further comprising an inserted frame having draw means with a following transverse cutting unit, wherein said basic frame further has belt rolls for a web path defined around the cutting cylinder and a chamber-like accommodation space located under the cutting cylinder and adapted to receive the inserted frame.

22. The folding apparatus as claimed in claim 21, wherein the inserted frame further has a folding blade and pin cylinder having a pin part, said folding blade and pin cylinder being adapted to engage the folding jaw cylinder on the basic frame, wherein the pin cylinder is provided with a cutting cylinder with a pin part which is driven by the pin part of the folding blade and pin cylinder, and wherein the folding blade is driven by the folding blade part thereof.

23. The folding apparatus as claimed in claim 11, wherein the basic frame further has a drive stub shaft, wherein the inserted frame includes a stub shaft and a transverse cutting unit with draw means to feed it, said inserted frame at least partly fitting into the accommodation space to engage the basic frame, and wherein said inserted frame is followed by a fan wheel fitting over a delivery belt forming a delivery unit, the parts thereof being adapted to be driven by means of said stub shaft aligned with the drive stub shaft on the basic frame.

* * * * *